US006824403B2

(12) United States Patent
Hall et al.

(10) Patent No.: US 6,824,403 B2
(45) Date of Patent: Nov. 30, 2004

(54) RIGHT ANGLE PRINTED CIRCUIT BOARD CONNECTOR APPARATUS, METHODS AND ARTICLES OF MANUFACTURE

(75) Inventors: John W. Hall, Harrisburg, PA (US); James M. Raudenbush, Halifax, PA (US); Douglas J. Hardy, Middletown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/024,859

(22) Filed: Dec. 18, 2001

(65) Prior Publication Data

US 2003/0114048 A1 Jun. 19, 2003

(51) Int. Cl.[7] ..... H11R 13/648

(52) U.S. Cl. ..... 439/108; 439/101; 439/578; 439/947; 439/63

(58) Field of Search ..... 439/578, 579, 439/580, 581, 582, 947, 63, 585, 680, 92, 95, 55, 296, 101

(56) References Cited

U.S. PATENT DOCUMENTS

| | | | | | |
|---|---|---|---|---|---|
| 3,378,321 | A | | 1/1974 | Patterson | 317/101 R |
| 4,797,120 | A | * | 1/1989 | Ulery | 439/578 |
| 4,846,719 | A | * | 7/1989 | Iwashita | 439/63 |
| 5,478,258 | A | | 12/1995 | Wang | 439/581 |
| 5,622,523 | A | * | 4/1997 | Kan et al. | 439/63 |
| 5,662,481 | A | * | 9/1997 | Wright | 439/581 |
| 5,735,699 | A | | 4/1998 | Tan et al. | 439/92 |
| 5,741,159 | A | * | 4/1998 | Wright | 439/63 |
| 6,074,218 | A | * | 6/2000 | Wu et al. | 439/63 |
| 6,227,904 | B1 | * | 5/2001 | Wang et al. | 439/63 |

FOREIGN PATENT DOCUMENTS

| | | | |
|---|---|---|---|
| EP | 0 321 213 A1 | 6/1989 | H01R/17/12 |

OTHER PUBLICATIONS

The American Heritage® Dictionary of the English Language, Third Edition copyright © 1992 by Houghton Mifflin Company.*

"Summary: Osram Sylvania announces Fakra SMB connector products" Sylvania press release dated Jun. 15, 2001.

* cited by examiner

*Primary Examiner*—P. Austin Bradley
*Assistant Examiner*—Briggitte R. Hammond

(57) ABSTRACT

Right angle apparatus, methods and articles of manufacture for connecting electrical components are disclosed. The preferred embodiments comprise a printed circuit board body element, grounding and keying elements, used to connect printed circuit boards with cables and the like. The preferred embodiments provide a grounded connection to a vehicle chassis or other ground.

13 Claims, 2 Drawing Sheets

RIGHT ANGLE PRINTED CIRCUIT BOARD CONNECTOR APPARATUS, METHODS AND ARTICLES OF MANUFACTURE

FIELD OF THE INVENTION

This invention relates to apparatus, methods and articles of manufacture for electrical connectors. More particularly, this invention relates to apparatus, methods and articles of manufacture for right angle electrical connectors for printed circuit boards and the like.

BACKGROUND OF THE INVENTION

A printed circuit board (PCB) connector is often used to provide an electrical interface between a PCB and a cable. A right angle PCB connector is often used to minimize the space required by PCB connectors and to ease the installation of cables to the connector.

Care must be taken when attaching to the connector. For example, the connections must be securely fastened so they do not come apart after installation. Additionally, they must be properly aligned so that an electrical connection is made upon installation.

In order to attempt to resolve these and other difficulties, various mechanisms have been used. Snap-in mechanisms are one such mechanism. Snap-in connectors provide convenient operation, allowing for quick and accurate installation. Moreover, a right angle snap-in connector permits a high board mount density, thus allowing for a number of connectors to be installed in a small area.

However, snap-in mechanisms may be confusing for the installer because of their similar appearance. If the confusion among possible connections leads the installer to make the wrong connection, the result could be disastrous.

In order to attempt to minimize confusion between snap fit type connectors, various standards have been established. One of those standards is referred to as FAKRA. This standard provides a system, based on keying and color coding, for proper connector attachment. Like connector keys can only be connected to like cable keys in FAKRA connectors. Thus secure locking and positioning of connector housings is provided.

Use of a standardized FAKRA and other similar connectors may lead to difficulties when designing a connector, however. A FAKRA connection may increase the space required for the connector. Additionally, and perhaps most importantly, a FAKRA connector, which is made of plastic, may interfere with the desired electrical connection, so, for example, grounding may be inhibited or non existent. Yet modification of a FAKRA type connector is extremely difficult because of their standardized construction.

Accordingly, it would be beneficial to have a small, effectively integrated mechanism for use in grounding FAKRA and other similar types of electrical connectors. Therefore, it is an object of the present invention to provide an small, integrated electrical connector.

It is yet a further object of the present invention to provide a small, lightweight electrical connector with an integrated grounding mechanism. It is a further object of the present invention to provide an FAKRA or similar type of electrical connector with grounding mechanisms that minimally, if at all, increases the size of the connector.

SUMMARY OF THE INVENTION

The present invention comprises right angle connector apparatus, methods and articles of manufacture. The preferred embodiments are used to connect printed circuit boards with cables and the like. The components of the preferred embodiments comprise a body, which in the especially preferred embodiment is a diecast printed circuit board jack, as well as ground and keying elements.

Upon assembly of the elements, and insertion in a device, the embodiment provides grounding to the device. In the embodiments used in a vehicle, grounding will usually be to the vehicle chassis.

The preferred embodiments provide grounding within a FAKRA or other similar type of standardized connector without altering the necessary standardized components and dimensions. Moreover, any desired audible and tactile feedback—assuring the connection has been established—is maintained.

DETAILED DESCRIPTION OF THE PREFERRED EMBODIMENTS

Figure 1:
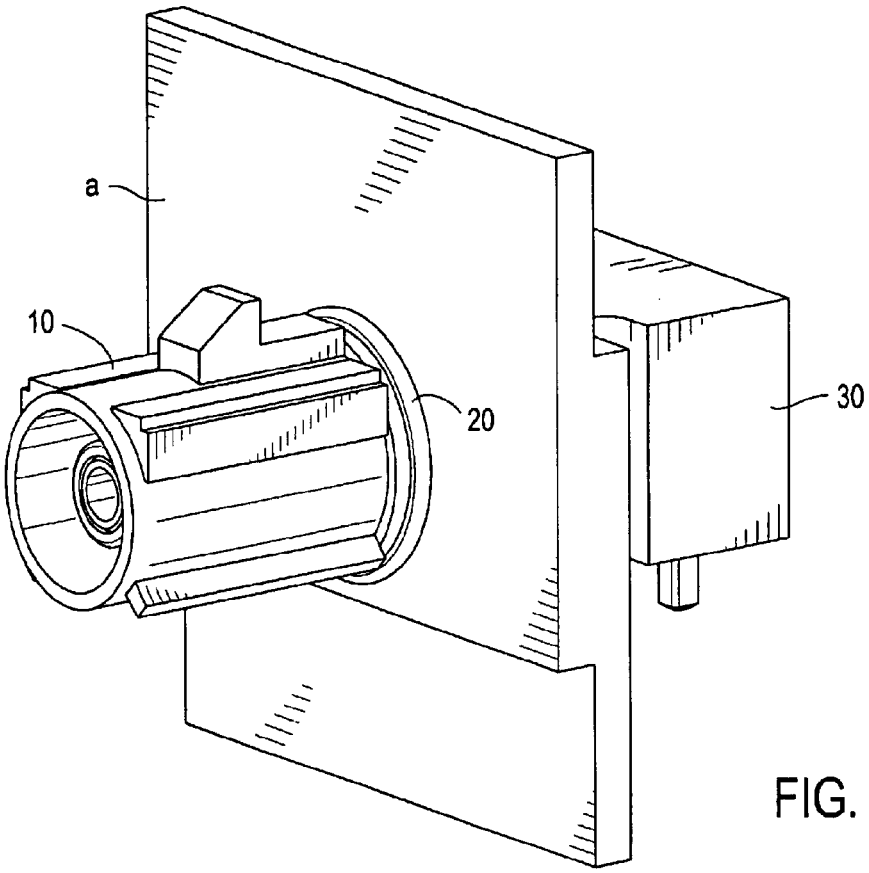
FIG. 1 shows a plan view of a preferred embodiment.

FIG. 1 shows a preferred embodiment of the present invention as it might be passed through surface a. Surface a is the desired grounding surface. In the especially preferred embodiment, surface a is a vehicle chassis.

Also visible in FIG. 1 is keying mechanism 10. Keying mechanism 10 provides appropriate snap fit or other connection as is known in the art for a cable or other connector. In the especially preferred embodiments, keying mechanism 10 is a color insert defined as appropriate according to the FAKRA standard.

Gasket 20 provides a grounding connection to surface a. In the especially preferred embodiments this is an EMI/RFI gasket, as the especially preferred embodiment is used in a RF environment, e.g. for digital satellite radio connections, global positioning systems, etc. Body 30 provides the plug in connection to the printed circuit board.

Figure 2:
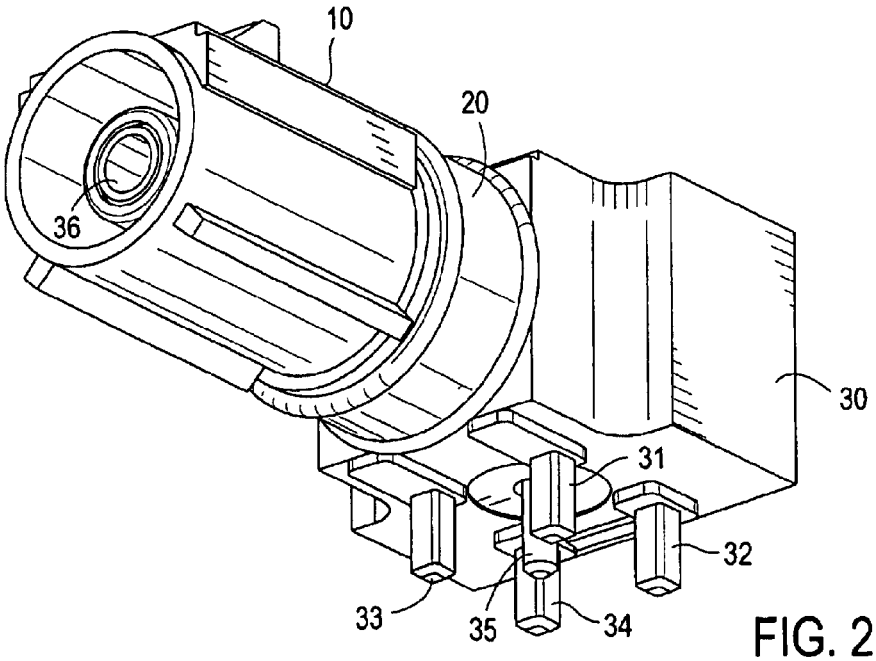
FIG. 2 shows a plan view of a preferred embodiment.

Turning now to FIG. 2 a view of a preferred embodiment is seen. Keying mechanism 10 is shown, as well as gasket 20 and body 30. Depending from body 30 are legs 31, 32, 33 and 34 providing plug in mounting to the printed circuit board as is known in the art. Also seen is electrical lead 35 which provides the electrical connection from the printed circuit board also as known in the art. Electrical lead 35 passes through body 30, gasket 20, and keying mechanism 10, terminating in end 36.

Figure 3:
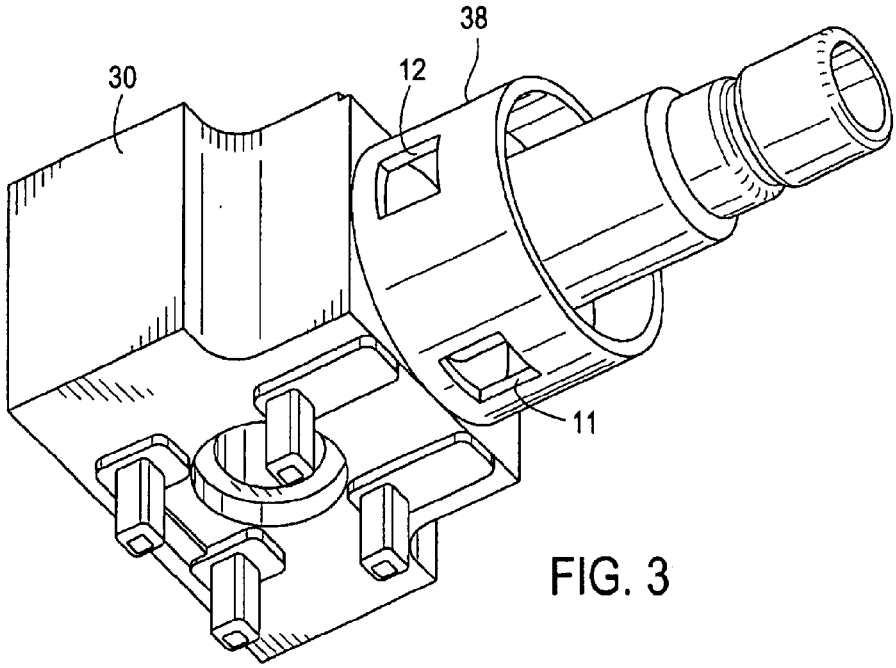
FIG. 3 shows a plan view of a preferred embodiment.

FIG. 3 shows body 30 with grounding extension 38 protruding therefrom. Grounding extension 38 provides a mounting for grounding element 20. Grounding extension 38 also provides cutouts 11 and 12 for mounting keying mechanism 10 in mating contiguous relationship thereupon. It should be noted that grounding extension 38 may provide any desired configuration for mating with keying mechanism 10, such as, in the especially preferred embodiments, when keying mechanism 10 comprises a standardized connector means, e.g. a FAKRA mount. In other embodiments, other mounting mechanisms may be used for keying mechanism 10 as desired.

Figure 4:
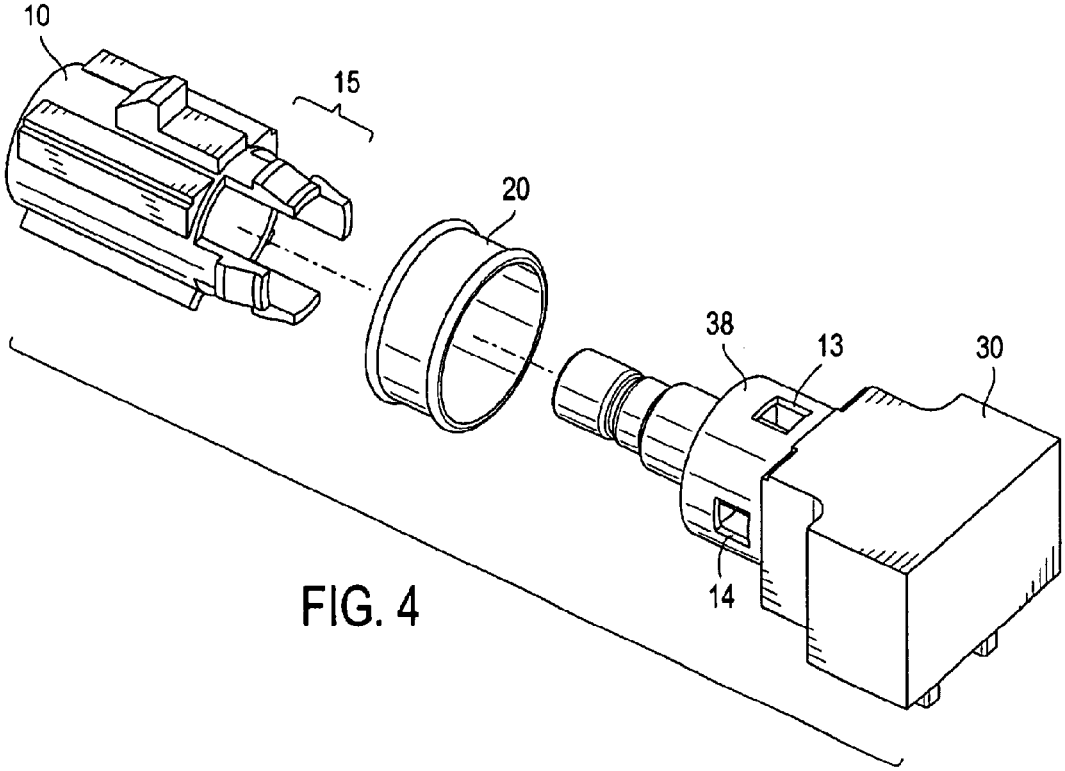
FIG. 4 shows a plan view of a preferred embodiment.

FIG. 4 shows a view of separated elements of a preferred embodiment. Keying mechanism 10 with engagement means shown generally at 15 mates with grounding extension 38, such as, for example, at cutouts 13 and 14, thus providing positive engagement with grounding extension 38. Annular grounding element 20 is displaced over grounding extension 38 once assembled as had been shown in FIG. 2. It should be noted that keying mechanism 10 shown in the embodiments of the Figure is a FAKRA connector. In other embodiments other mechanisms may be used as desired.

It should be noted that grounding element 20 and grounding extension 38 are used herein to denote a first and second grounding element respectively. The first and second elements are to be understood as connector components so that, when properly connected, a desired ground is made between the elements.

Other connector elements apart from FAKRA or similar types may be used in various embodiments as desired. In the especially preferred embodiment a FAKRA SMB connector is used. However other connectors known in the art may also be used.

The various elements are made of materials such as are known in the art. For example a FAKRA compliant keying mechanism may be made of various plastics, such as Teflon, polypropylene, and polymethylpentene. A Body element is also constructed from suitable material as is known in the art, such a diecast zinc or similar materials. Grounding elements may be constructed of suitable grounding material as known in the art. Preferably the embodiment is weighted as well thus preventing tipping during installation.

The above description and the views and material depicted by the figures are for purposes of illustration only and are not intended to be, and should not be construed as, limitations on the invention.

Moreover, certain modifications or alternatives may suggest themselves to those skilled in the art upon reading of this specification, all of which are intended to be within the spirit and scope of the present invention as defined in the attached claims.

We claim:

1. An apparatus for connecting electrical components comprising:

a substantially annular keying element having a ribbed outer surface;

a first grounding element;

a second grounding element configured to receive said first grounding element;

a body element configured for connection to a printed circuit board, said second grounding element extending from said body element;

whereby, said first and second grounding elements provide a grounding connection to a predetermined ground upon connection of said keying element to said predetermined connector and said body element to said printed circuit board.

2. An apparatus as in claim 1 wherein said body element further comprises a printed circuit board jack.

3. An apparatus as in claim 1 wherein said keying element comprises a standardized connector.

4. An apparatus as in claim 3 wherein said standardized connector further comprises a FAKRA compliant connector.

5. An apparatus as in claim 1 wherein said first grounding element is removeably mounted upon said second grounding element.

6. An apparatus as in claim 5 wherein said first grounding element comprises an annular grounding element.

7. An apparatus for connecting electrical components comprising:

a keying element comprising a standardized connector adapted for connecting to a predetermined connector via ribs on an outer surface thereof;

a substantially annular first grounding element;

a substantially annular second grounding element configured for connection with said first grounding element;

a body element jack having mounted thereon said second grounding element, said body element jack configured for connection to a printed circuit board;

whereby, said first and second grounding elements provide a grounding connection to a predetermined ground upon connection of said keying element to said predetermined connector and said body element jack to said printed circuit board.

8. A method for connecting electrical components comprising:

providing substantially first and second annular grounding elements and a FAKRA electrical connector having a ribbed outer surface, the second grounding element provided upon a body element;

inserting the first grounding element over the second grounding element;

inserting an end of the FAKRA connector through the first grounding element; and coupling the FAKRA connector to the second grounding element, thereby providing an electrical connection and ground for the FAKRA electrical connector.

9. A method for connecting electrical components comprising:

connecting a first grounding element to a second grounding element, whereby said second grounding element is mounted to a body element jack adapted to connect to a printed circuit board; and, connecting a keying element having a ribbed outer surface to said body element jack;

so that any electrical connection created by connecting said keying element to said body element jack is grounded by said connection of said first grounding element to said second grounding element.

10. An article of manufacture for connecting standardized RE electrical components to a printed circuit board, comprising:

a keying element configured for receiving a predetermined electrical connector;

a body element jack configured for mounting to a printed circuit board and comprising an annular second grounding element extending therefrom, said second grounding element comprising a mounting surface;

a first grounding element connected to said second grounding element; and said keying element fastened to said mounting surface.

11. An electrical connector comprising:

a body element having a first portion configured to be mounted to a printed circuit board and a second portion comprising an annular grounding element extending therefrom;

a standardized connector comprising a keyed outer surface and configured for removable connection to said annular grounding element; and an annular grounding gasket surrounding said grounding element and situated in between said first portion of said body element and said keyed outer surface.

12. A right angle electrical connector comprising:

a body element comprising a first surface configured for mounting to a printed circuit board and a second surface configured for mounting to a standardized keying connector, said first surface and said second surfaces substantially perpendicular to one another;

a grounding element extending from said second surface and comprising a substantially annular member projecting from said second surface;

a grounding gasket fitted over said annular member; and a standardized keying connector inserted through at least a portion of said grounding gasket and removably coupled to said grounding element.

13. A right angle electrical connector comprising:

a body element comprising a first surface configured for mounting to a printed circuit board and a second surface configured for mounting to a standardized keying connector, said first surface and said second surfaces substantially perpendicular to one another;

a grounding element extending from said second surface and comprising a substantially annular member extending therefrom, said annular member including cut-out portions therein;

a grounding gasket fitted over said annular member; and a standardized keying connector inserted through at least a portion of said grounding gasket and engaged to said grounding element via the cut-out portions.

* * * * *